US006072111A

United States Patent [19]

Senn

[11] Patent Number: 6,072,111

[45] Date of Patent: Jun. 6, 2000

[54] DEVICE FOR PRODUCING AT LEAST ONE SOUND

[76] Inventor: Friedrich Senn, Gottlieber Strasse 23, D-78462 Constance, Germany

[21] Appl. No.: 08/776,330

[22] PCT Filed: Jul. 19, 1995

[86] PCT No.: PCT/EP95/02840

§ 371 Date: Apr. 24, 1997

§ 102(e) Date: Apr. 24, 1997

[87] PCT Pub. No.: WO96/04643

PCT Pub. Date: Feb. 15, 1996

[30] Foreign Application Priority Data

Jul. 30, 1994 [DE] Germany ..... 44 27 133

[51] Int. Cl.[7] ..... G10D 13/02

[52] U.S. Cl. ..... 84/402; 84/403; 84/408; 84/410

[58] Field of Search ..... 84/402, 403, 410, 84/408

[56] References Cited

U.S. PATENT DOCUMENTS

| | | | |
|---|---|---|---|
| 2,504,915 | 4/1950 | Zimmerman | 84/403 |
| 3,102,510 | 9/1963 | Hershey et al. | 116/148 |
| 3,633,453 | 1/1972 | Musser | 84/403 |
| 4,619,178 | 10/1986 | Kodoh | 84/410 |
| 4,718,964 | 1/1988 | Sawada et al. | 156/252 |
| 5,207,769 | 5/1993 | Malta | 84/404 |
| 5,602,354 | 2/1997 | Martin | 84/410 |

*Primary Examiner*—Robert E. Nappi
*Assistant Examiner*—Kim Lockett
*Attorney, Agent, or Firm*—Bachman & LaPointe, P.C.

[57] ABSTRACT

In a device for generating at least one sound by means of at least one sounding board (1) with vibrationally neutral surfaces, the sounding board (1) is joined to a holder (2) at least in the area of a vibrationally neutral surface.

21 Claims, 8 Drawing Sheets

DEVICE FOR PRODUCING AT LEAST ONE SOUND

The present invention relates to a device for producing at least one sound by means of at least one sounding plate which has vibrationally neutral surfaces.

So-called plate bells are known in which one or more rectangular metal plates are suspended vertically by cords in a frame and are caused to give off sounds by drumsticks or mallets. The holes to receive the cords are located at vibrationally neutral points on the diagonals of the sounding plates (generally at a distance of one-fifth the diagonal from the two upper corners). The sounding plate is suspended in such a manner that its wide side is horizontal.

A sounding plate which is suspended at these points produces, when struck, longitudinal, transverse, and diagonal vibrations, i.e. different frequencies corresponding to the different side ratios are produced, they, however, having a high proportion of noise.

Since sounding plates of the previously known type are suspended vertically, playing on them is cumbersome and fatiguing. Furthermore, a continuous pendulum movement after striking prevents rapid repetitions of the sound, which makes further striking of sounds impossible. Since these sounding plates are very loud even without additional resonators as a result of their relatively large radiation surface, they form the basis for a new type of sounding plate which can be used both in the bass and in the treble regions.

The object of the present invention is to create a device of the above-indicated type which also has the advantages (loud sound without resonator, large tone range) but which, furthermore, can produce an extremely pure tone and can be played in both horizontal and vertical position.

In order to achieve this object, the sounding plate is attached to a holder at least in the region of a vibrationally neutral surface.

By means of the holder, the sounding plate is held relatively rigidly, in particular in horizontal or inclined position, so that playing of the sounding plate can be effected better and faster. During the playing, the musician can move freely around the room and use his steps in this connection as meter, which is very important in the early musical education of children. A large number of tuned sounding plates can be combined with each other in any desired arrangement, for instance so as to form a chromatic instrument with piano arrangement.

The holder preferably consists of a foam material, at least at the place of connection with the sounding plate. For this, there is particularly suitable a plastic foam or, for instance, also a sponge rubber. The foam should, in this connection, have at least a stiffness which, on the one hand, does not interfere with the vibration of the sounding plate but at least holds the sounding plate in a desired position. For the sake of simplicity, the foam rubber has a pocket or a slot into which the sounding plate is inserted. The sounding plate can be glued or otherwise held fast therein.

In order better to delimit vibrationally neutral surfaces from vibrating surfaces, the sounding plate should have indentations and particularly slits. In individual cases, one slit may be sufficient. Preferably, however, there are two slits, a tongue being formed between the two slits and the holder being fastened to that tongue. In this way there is a clear demarcation between active and passive vibrational surfaces, which leads to a lengthening of the dying-out time. At the same time, the sounding plate is thereby precisely tuned.

For the tuning of the sounding plate, grooves of any desired geometrical arrangement or troughs can be developed on its surface. There is no limit here in the inventive concept.

In a preferred embodiment, the sounding plate is approximately square. A square sounding plate which is struck at the center and is held in the center of any side thereof forms vibrationally neutral surfaces (passive surfaces) at the centers of the four sides, which surfaces are suitable for attachment to a holder. The very pure sound produced with a sounding plate held in this manner sounds like the so-called flageolet tone. The producing of a frequency mixture such as would be the case with a sounding plate suspended in the traditional manner (vibrationally neutral surfaces of the diagonal) is hereby intentionally prevented.

A square sounding plate with passive surfaces on its sides forms a vibration nodal line which connects the passive surfaces with each other in the form of a square. In order to create a practical holder which permits the attachment of a grip or which permits the combining of several sounding plates into a multi-tone instrument in one frame, the passive surfaces must be enlarged. This is done by the abovementioned double slits on each side, in each case in the direction towards the opposite side. The enlarged passive surfaces in the form of tongues which are thus obtained are suitable to receive holders which, in their turn, can attach the sounding plate to a grip or a fixed frame, as described further below.

Instead of a square sounding plate, the shape of a rectangle can be used—without loss in tonal quality—in which case, with a rectangular sounding plate, two vibration nodal lines in the form of uniform arcs are produced, each of which ends in the third of the two wide sides as vibrationally neutral surfaces. On each of these surfaces, the sounding plate is provided with a holder, whereby a holder of the sounding plate on both sides and thus a horizontal as well as a vertical holder, is made possible.

The sounding plates of the present invention can be produced simply and economically. Thus, for instance, several interconnected sounding plates can be produced by milling, sawing, or stamping the plate contours from a larger metal plate, they together resulting in a multiple-tone instrument. This is done in a manner similar to a slit drum the sound tongues of which are also produced by the same manufacturing technique.

Furthermore, rolled sheet is preferably used for the production of sounding plates since it has a high precision of material and only a slight amount of finishing work is necessary. The direction of rolling should, in this case, be transverse to the sounding plate.

One essential part of the present invention refers also to the holder. In a preferred embodiment, this holder consists of a grip part and a grip head. The grip part can be inserted in any desired support, so that the sounding plate is held in the desired position.

In one embodiment, the grip part and grip head are produced in one piece from a foam material. In this case, to be sure, a foam must be used which has sufficient strength to hold the sounding plate in the desired position. For this reason, the grip part should be hardened at least in part on its surface.

Another possibility consists in producing the grip part of a harder material, such as for instance plastic, wood, cork, metal, or the like, and then attaching this grip part to the grip handle of foam. Without going beyond the invention, this attachment can be permanent or else also detachable. In the latter case, the grip head is then developed as a replaceable head.

A grip part can also be so developed that by it several grip heads are connected with sounding plates in order to produce different tones.

Although the sounding plates held the holder already have excellent volume, it may be advisable, in an individual case, to associate the sounding plates with a resonance box. In this case, the resonance box then has receivers for holders which, for instance, hold a square sounding plate on all four sides. This, however, merely constitutes one illustrative embodiment.

It is also possible to arrange a plurality of sounding plates in a frame, the sounding plates being attached to the frame and to each other by foam holders. The sounding plates may also be formed in one piece from a metal strip and be produced with an upright fence strip or connecting tongues left standing correspondingly among each other. Since these connecting zones are located in the tonally neutral region, the sounding plates can still vibrate freely. Many other possibilities are also conceivable.

Further advantages, features and details of the invention will become evident from the following description of preferred embodiments, read with reference to the drawing, in which.

Figure 7B:
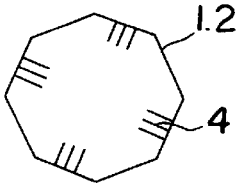
Figure 7C:
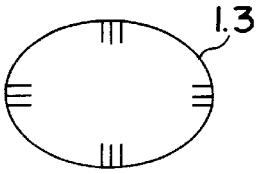
Figure 7A:
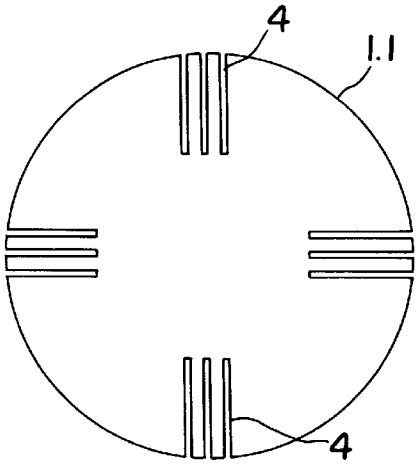
Figure 9A:
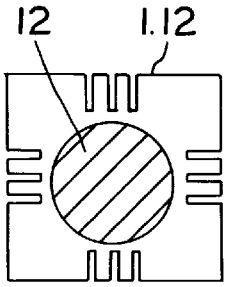
Figure 9B:
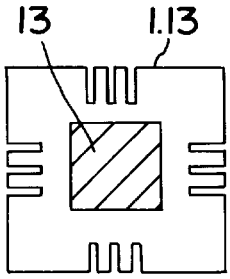
Figure 9C:
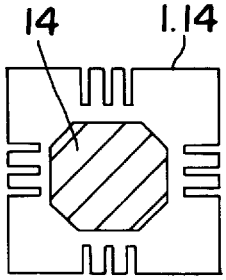
Figure 11:
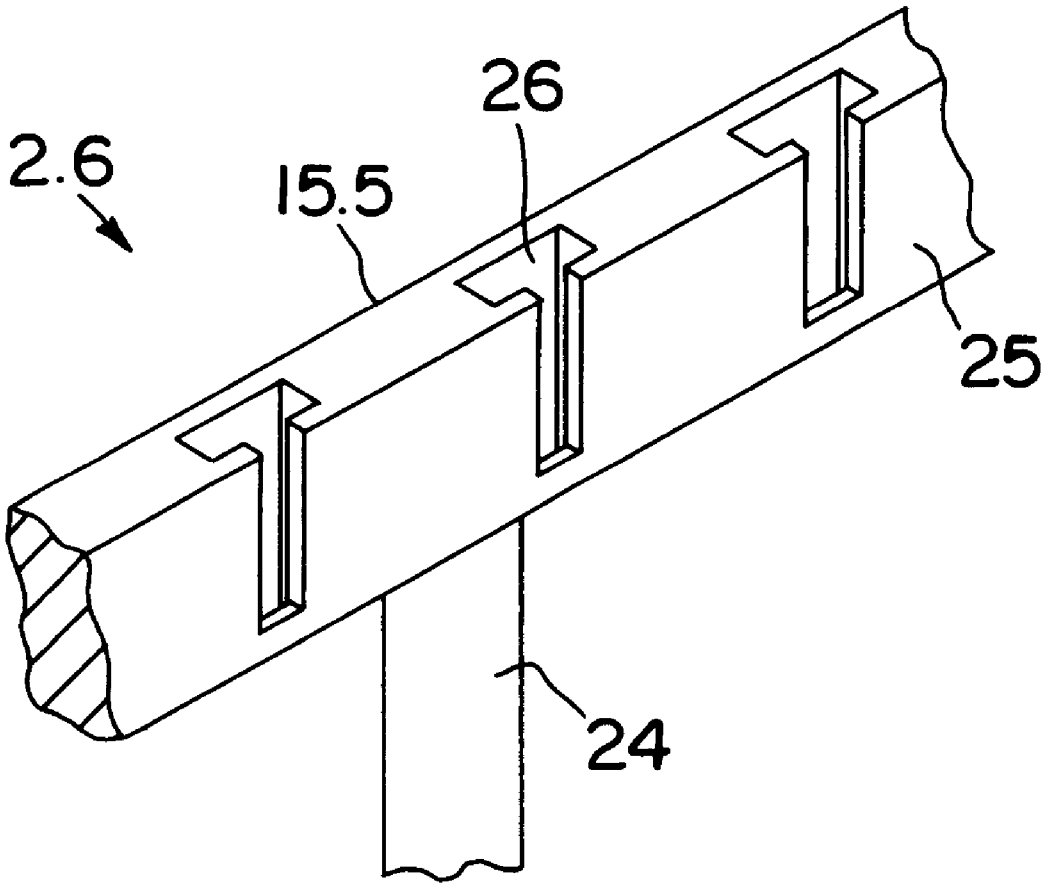
Figure 12:
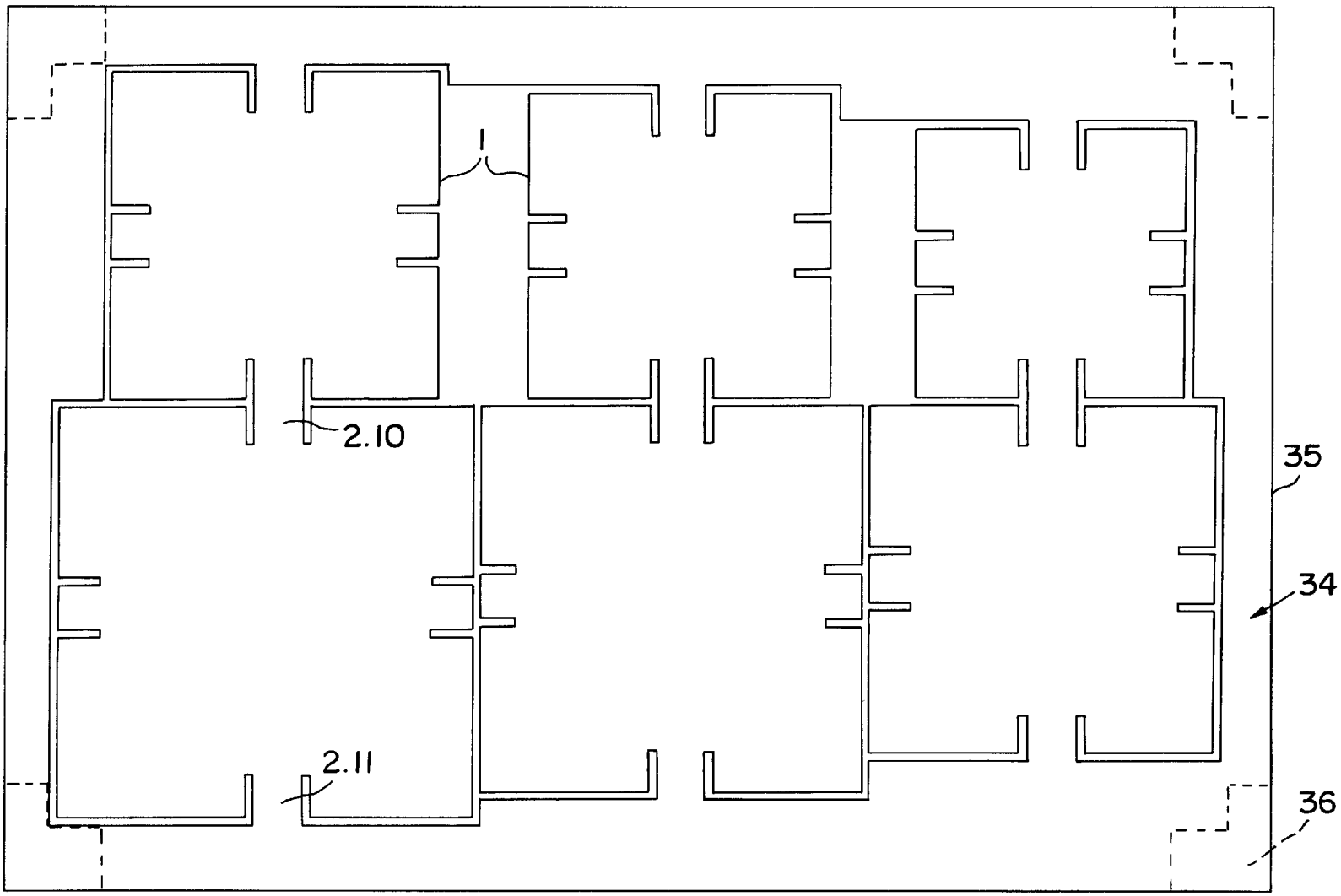

FIGS. 6*a* to 6*d* are top views of embodiments of sounding plates;

FIGS. 7*a* to 7*c* are top views of embodiments of sounding plates of different geometrical shapes;

FIGS. 8*a* to 8*f* are bottom views of sounding plates with different grooves milled or ground therein;

FIGS. 9*a* to 9*c* are bottom views of sounding plates having different recesses;

FIGS. 10*a* to 10*f* are side views of different embodiments of holders and parts thereof;

FIG. 11 is a perspective view of a part of a multiple holder;

FIG. 12 is a top view of several interconnected sounding plates.

Figure 1:
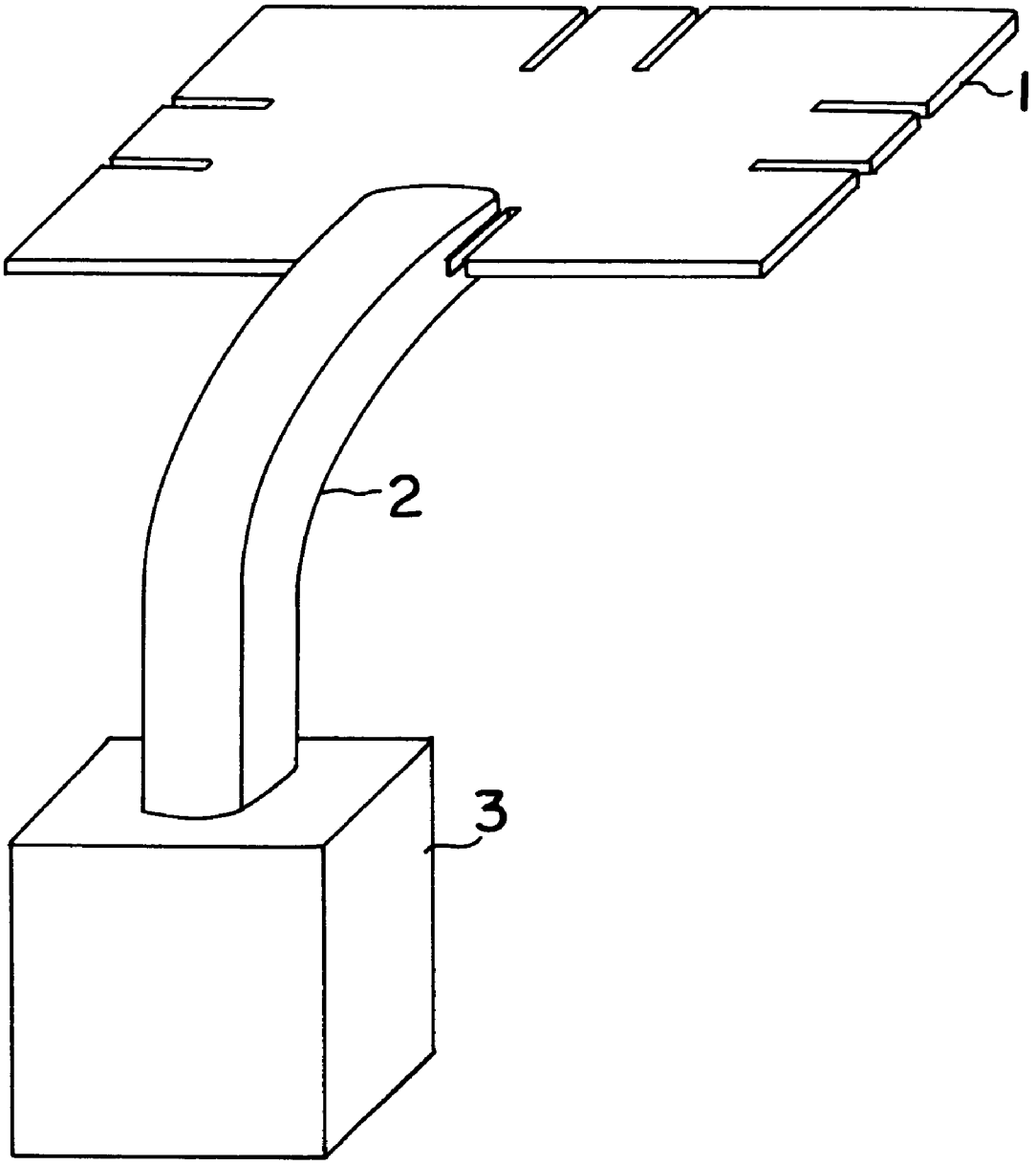
FIG. 1 is a perspective view of a device in accordance with the invention for the production of a sound.

A device in accordance with the invention for the producing of a sound has, in accordance with FIG. 1, a sounding plate 1 which is fixed on a holder 2. In the present embodiment the holder 2 is inserted detachably or permanently in a stand 3.

It is known that every sounding plate has vibrational surfaces and vibrationally neutral surfaces (passive surfaces). A square plate which is struck at its center and is held in the middle of any side forms vibrationally neutral surfaces at the center of all four sides, these surfaces being suitable for the fastening of a holder. The square sounding plate forms a vibration nodal line which connects the passive surfaces to each other in the form of a square.

In the case of a rectangular sounding plate, two vibration nodal lines are produced in the form of uniform arcs, each of which terminates in the third of the two wide sides as vibrationally neutral surfaces. Thus, these surfaces are available for the fastening of the holder.

However, other outer contours of the sounding plates are also conceivable, as shown in FIG. 7. FIG. 7*a* shows a sounding plate 1.1 of round shape. FIG. 7*b* refers to a sounding plate 1.2 of octagonal shape, and FIG. 7*c* shows a sounding plate 1.3 of elliptical shape. These, however, are intended merely as examples and a large number of other geometrical shapes are also conceivable, all of which are covered by the inventive concept.

In order, however, to obtain a clear delimitation between vibrating surfaces and vibrationally neutral surfaces, i.e. between active and passive surfaces, it has been discovered that slits in the sounding plates in their passive surfaces lead specifically to this separation or delimitation and at the same time result in a lengthening of the decay times. Furthermore, the sounding plate is finely tuned by slits.

In FIG. 6, various possibilities for the slits 4 are shown. FIG. 6*a* shows a square sounding plate 1 which has double slits 4 on all opposite sides. In this connection, the slits are so developed that they are the same length and symmetrically arranged on all four sides. In this way, the purity of the sound is not impaired.

Figure 6A:
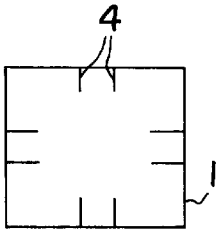
Figure 6B:
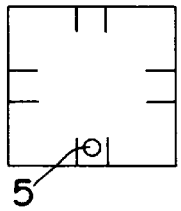
Figure 6C:
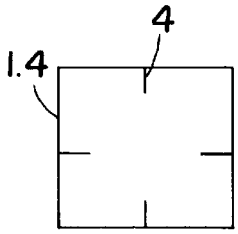
Figure 6D:
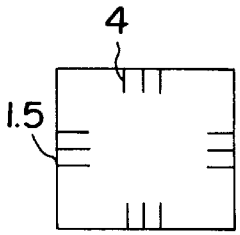

However, there is also possible a sounding plate 1.4 having in each case only one slit 4 on each side, or a sounding plate 1.5 having three slits 4 on each side. These are shown in FIGS. 6*c* and 6*d*.

Since the slits 4 are in vibrationally neutral surfaces, a hole 5 can also be arranged there, it serving for instance (see FIG. 6*b*) for the better fastening of the holder 2.

Figure 8A:
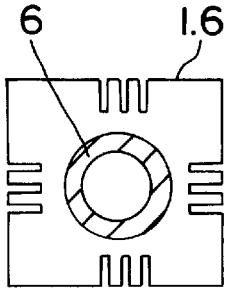
Figure 8B:
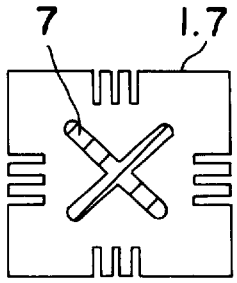
Figure 8C:
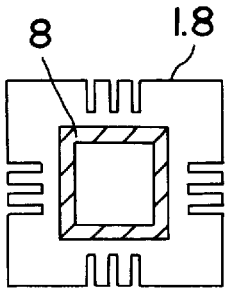
Figure 8D:
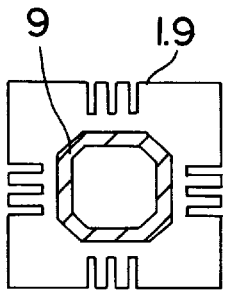
Figure 8E:
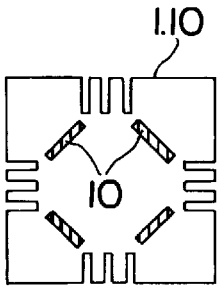
Figure 8F:
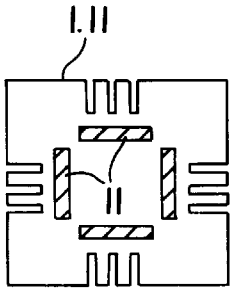

Tuning of the sounding plates can also be effected by grooves which are milled therein, as shown in FIGS. 8*a* to 8*f*. FIG. 8*a* shows a sounding plate 1.6 having a circular groove 6 arranged approximately at its center. FIG. 8*b* shows a sounding plate 1.7 having an X-shaped groove 7; FIG. 8*c* shows a sounding plate 1.8 having a rectangular groove 8; FIG. 8*d* shows a sounding plate 1.9 having an octagonal groove 9; FIG. 8*e* shows a sounding plate 1.10 having groove sections 10 arranged parallel to the diagonals, and FIG. 8*f* shows a sounding plate 1.11 having groove sections 11 arranged parallel to the sides. These also are merely examples which show further embodiments which fall within the scope of the present invention.

An influencing of the quality of the sound similar to that obtained by grooves is obtained by millings, such as shown in FIGS. 9*a* to 9*c*. In this case, the bottom view of FIG. 9*a* shows a circular trough 12 in the sounding plate 1.12; FIG. 9*b* shows a rectangular trough 13 in the sounding plate 1.13; and FIG. 9*c* shows an octagonal trough 14 in the sounding plate 1.1.4.

Figure 10A:
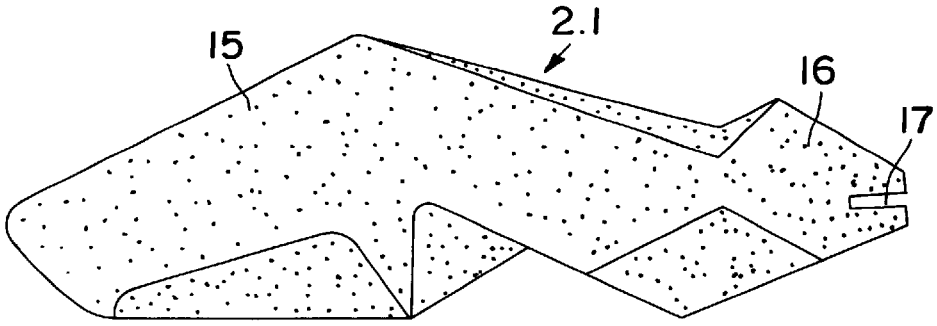

Such a sounding plate is fastened, as mentioned above, to a holder 2. This holder 2 preferably consists of foam since in that way the vibrating of the sounding plate is not impaired. One embodiment of a holder 2.1 is shown in FIG. 10*a*. This holder 2.1 consists of a grip part 15 and grip head 16. Within the grip head 16 there is formed a slot-shaped pocket 17 which serves to receive the sounding plate 1. The attachment between grip head 16 and sounding plate 1 can be effected by gluing, melting, or direct foaming with or without a securing of the retention in the form of a deepening or hole in the sounding plate.

In order that the flexible plastic foam material has sufficient strength, the holder 2.1 can be hardened on its surface. It is furthermore possible to introduce a counterweight to the sounding plate 1 into the grip part 15, i.e. introduce it by foaming, grouting, or insertion.

Instead of hardening the surface, it is also possible for the center of the grip part 15 to consist of plastic foam material which is then surrounded by a harder plastic shell.

Figure 10B:
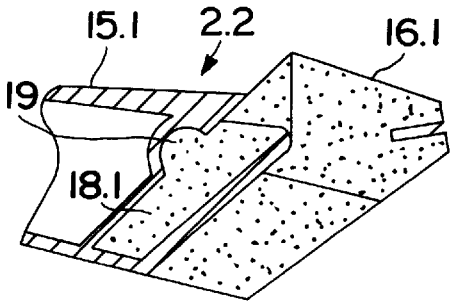
Figure 10C:
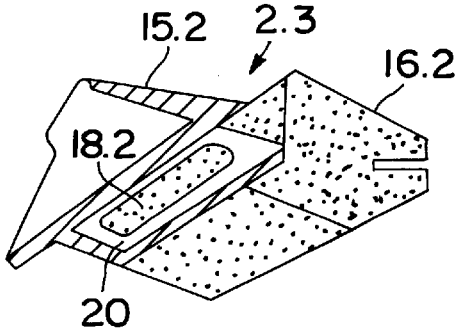

In the embodiment according to FIGS. 10*b* and 10*c*, in each case a holder 2.2 and 2.3 is formed of several parts. The grip part 15.1 and 15.2 consists of stiff material, such as, for instance, plastic, wood, cork, or metal, while the grip head 16.1 and 16.2 is again formed of flexible plastic foam material or sponge rubber.

For the connecting of grip heads 16.1 or 16.2 and grip parts 15.1 and 15.2 respectively, the grip parts 15.1 and 15.2 have a cavity 18.1 and 18.2 respectively into which the grip heads 16.1 and 16.2 are introduced, foamed in place, or grouted in place. They can be fastened by gluing, by the development of a detent nose 19, or by the pushing-in of lateral locking pins 20.

Figure 10D:
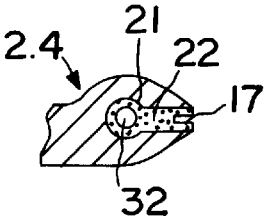

In FIG. 10*d*, the grip head also consists essentially of rigid material, such as, for instance, plastic, wood, cork, or metal. However, there is formed within it a weatherstrip groove 21 which is filled with the plastic foam material or sponge rubber. This insert 22 can be pushed laterally into the weatherstrip groove 21. However, foaming in place or grouting is also possible. Furthermore, a transverse hole 32 is provided in the insert 22 by which its weight is reduced and the vibrational damping thus also reduced. Such a transverse hole can furthermore also be provided in the other grip heads of FIG. 10.

Figure 10E:
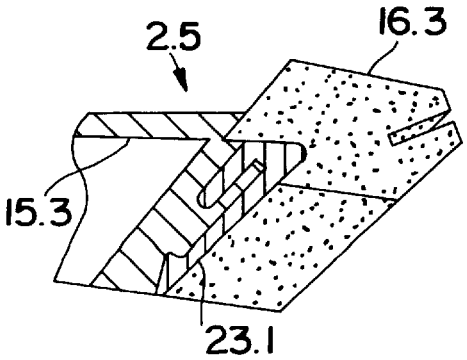
Figure 10F:
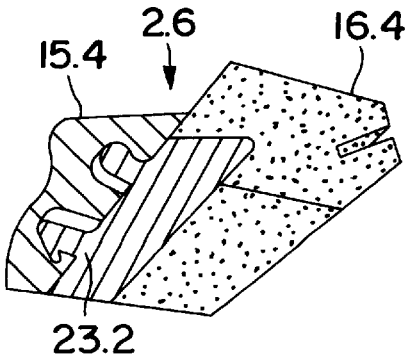

FIGS. 10*e* and 10*f* show the development of holders 2.5 and 2.6 with replaceable grip heads 16.3 and 16.4 respectively. In both cases different detent elements 23.1 and 23.2 are connected to the grip heads 16.3 and 16.4 respectively, said detent elements entering into a detent or clip connection with the grip parts 15.3 and 15.4 respectively. The detent elements 23.1 and 23.2 and the grip heads 16.3 and 16.4 are preferably permanently attached to each other. This arrangement permits, for only one grip part, a replacement of the grip heads 16 with different sounding plates so that different sequences of sounds one after the other are possible.

In FIG. 11 it is also shown that a plurality of grip heads 16 can be attached to a grip part 15.5. For this purpose, the grip part 15.5 has a stem 24 and a transverse rail 25 in which T-grooves 26 are formed. In order that corresponding grip heads, not shown, can be inserted into the T-grooves, they have for instance, instead of the detent elements 23, corresponding T-rails. The grip part 15.5 could also have only one T-groove to receive only one grip head. Instead of the T-grooves, the grip part 15.5 could also have other connecting or detent devices for grip heads.

Figure 2:
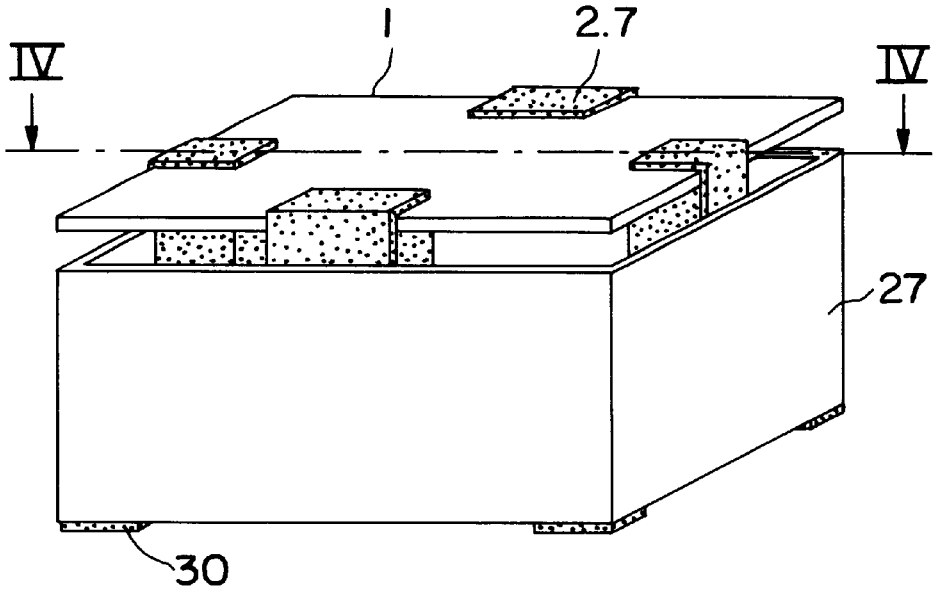
FIG. 2 is a perspective view of another embodiment of a device in accordance with the invention for the production of a sound.
Figure 3:
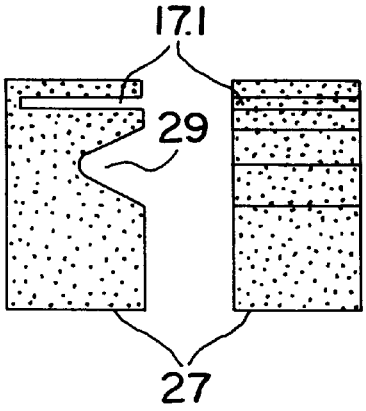
FIG. 3 is a side view and a front view of a holder in accordance with the invention for a sounding plate.
Figure 4:
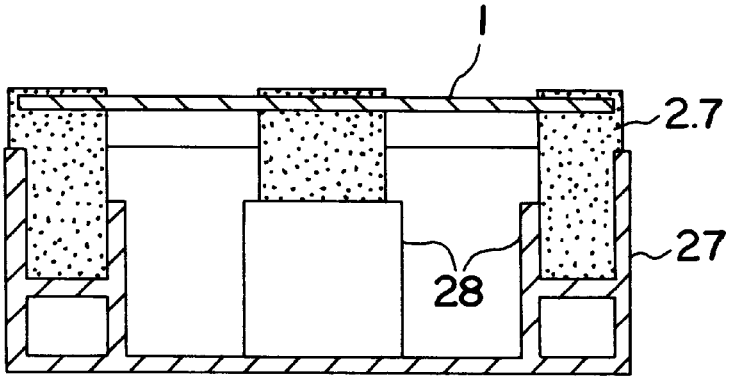
FIG. 4 is a cross section through the device of FIG. 2 along the line IV—IV.

While in the embodiment of FIG. 1, the sounding plate 1 is held only on one side in the region of the passive surface, a sounding plate 1 in accordance with FIG. 2 is fixed on all four sides. In this case, the sounding plate 1 has associated with it a resonance box 27 which can consist, for instance, of wood or plastic. The resonance box 27, as shown in FIG. 4, has, within it, receivers 28 in which holders 2.7 are inserted. Each holder 2.7 consists, in accordance with FIG. 3, of a block of foam material which has a pocket 17.1 to receive the sounding plate 1. Furthermore, a wedge-shaped recess 29 is formed in the holder 2.7, it serving for the better resilience of the sounding plate 1. However, this is merely an improved embodiment.

The resonance box 27 is advantageously supported by feet 30 of a soft materials such as, for instance foam, felt or the like, on a base, whereby the quality of the sound is also improved.

Of course, it may also be sufficient to fix the sounding plate 1 only on one, two, or three sides.

Figure 5:
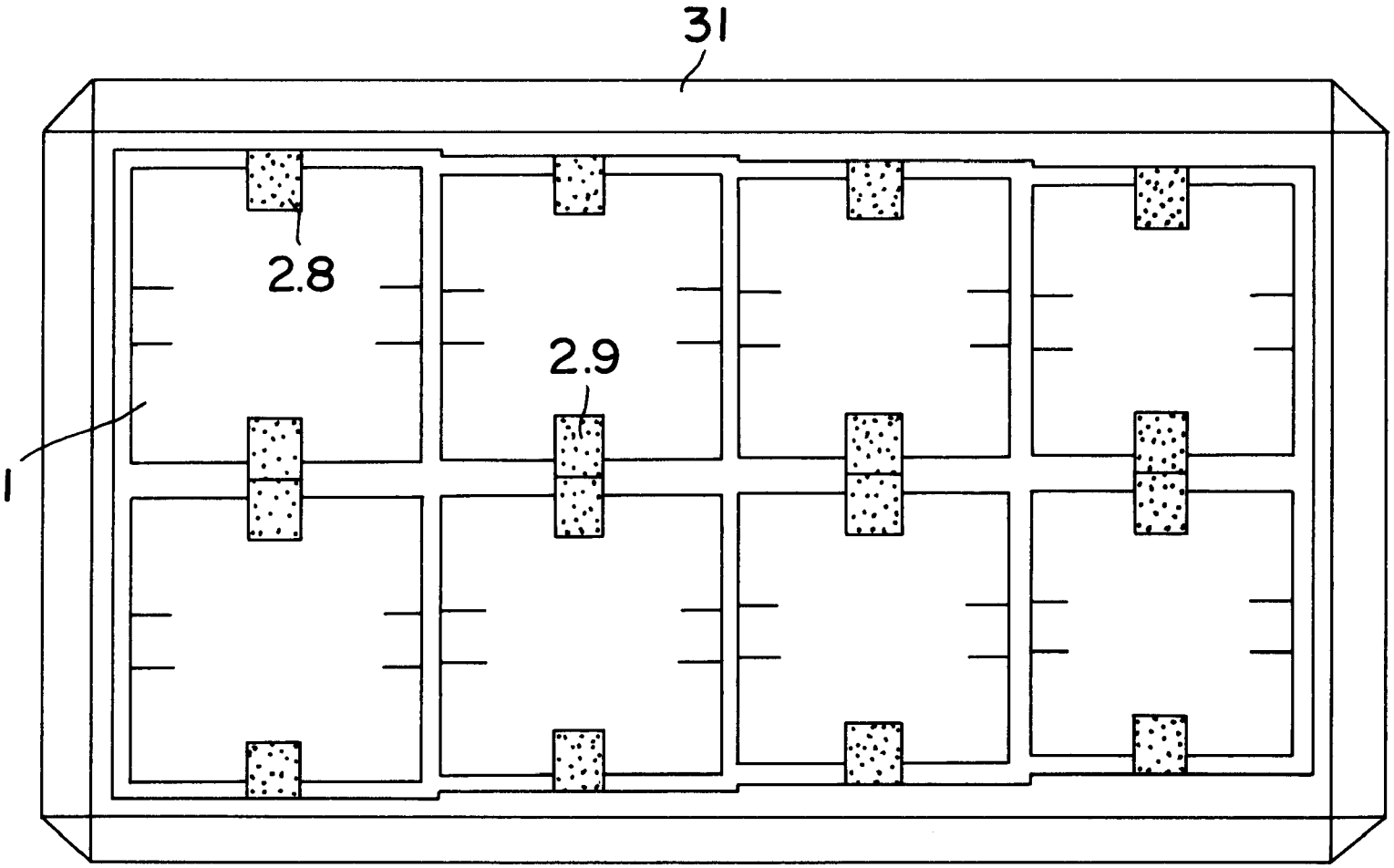
FIG. 5 is a top view of another embodiment of the device for producing sounds.

In FIG. 5, it is shown that a plurality of sounding plates 1 of different size or sounding plates having different inward or outward millings can be arranged on a frame 31. This frame can also again be made of plastic or wood. Holders 2.8, which again consist of foam, metal or the like, are connected to the frame. If two sounding plates 1 adjoin each other, they can be connected to each other by holders 2.9.

Another possibility for a holder 2.10 is shown in FIG. 12. In that case, several sounding plates 1 are developed from a metal sheet 34. In this case, an outer fence strip 35 remains which is connected with sounding plates 1 via tongues left via a holder 2.11. The above-mentioned holders 2.10 are connecting tongues which have been left standing between adjacent sounding plates 1. On the side, the metal sheet is backed by foam feet 36.

The production of such a metal sheet 14 with integrated sounding plates 1 is effected, for instance, by milling, stamping, nippling, laser cutting or water-jet cutting. These are merely a few methods of production.

What is claimed is:

1. A musical instrument for producing at least one sound by means of at least one sounding plate, which comprises said sounding plate having vibrationally neutral surfaces, wherein said sounding plate is connected with a separate holder element at least in the region of a vibrationally neutral surface, and wherein in the region of at least one vibrationally neutral surface said sounding plate has at least one slit in the regions of which the attachment to the holder is also effected.

2. A musical instrument for producing at least one sound by means of at least one sounding plate, which comprises said sounding plate having vibrationally neutral surfaces, wherein said sounding plate is connected with a holder at least in the region of a vibrationally neutral surface, and wherein in the region of at least one vibrationally neutral surface said sounding plate has at least one slit in the regions of which the attachment to the holder is also effected, wherein the holder consists of a foam, at least at the place of attachment to the sounding plate.

3. A musical instrument according to claim 2, wherein the sounding plate is fixed in a pocket formed in the foam material in the region of at least one vibrationally neutral surface.

4. A musical instrument according to claim 1, wherein the sounding plate has two slits.

5. A musical instrument according to claim 1, wherein in the region of the vibrationally neutral surfaces there is at least one hole for attachment to the holder.

6. A musical instrument for producing at least one sound by means of at least one sounding plate, which comprises said sounding plate having vibrationally neutral surfaces, wherein said sounding plate is connected with a holder at least in the region of a vibrationally neutral surface, and wherein in the region of at least one vibrationally neutral surface said sounding plate has at least one slit in the regions of which the attachment to the holder is also effected, wherein at least one groove is formed in the bottom surface of the sounding plate.

7. A musical instrument according to claim 1, wherein the outer contour of the sounding plate is square.

8. A musical instrument according to claim 1, wherein a resonance box is associated with the sounding plate.

9. A musical instrument according to claim 8, wherein a resonance box has receivers for holders which hold an approximately square sounding plate on all four sides.

10. A musical instrument according to claim 9, wherein said holders are developed in block-like form and each of them has a recess.

11. A musical instrument for producing at least one sound by means of at least one sounding plate, which comprises said sounding plate having vibrationally neutral surfaces, wherein said sounding plate is connected with a holder at least in the region of a vibrationally neutral surface, and wherein in the region of at least one vibrationally neutral surface said sounding plate has at least one slit in the regions of which the attachment to the holder is also effected, wherein a plurality of sounding plates are arranged in at least one of a frame and fence strip and are connected with at least one of said frame, fence strip and one another via holders.

12. A musical instrument according to claim 11, wherein said holders connect the sounding plates in one piece with at least one of said fence strip and each other.

13. A musical instrument for producing at least one sound by means of at least one sounding plate, which comprises said sounding plate having vibrationally neutral surfaces, wherein said sounding plate is connected with a holder at least in the region of a vibrationally neutral surface, and wherein at least one trough is formed in a bottom surface of the sounding plate.

14. A musical instrument for producing at least one sound by means of at least one sounding plate, which comprises said sounding plate having vibrationally neutral surfaces, wherein said sounding plate is connected with a holder at least in the region of a vibrationally neutral surface, and wherein said holder includes a grip part and a grip head.

15. A musical instrument according to claim 14, wherein said grip part and grip head are produced in one piece from a foam material.

16. A musical instrument according to claim 14, wherein said grip part consists of a harder material selected from the group consisting of plastic, wood, cork and metal, and said grip head is formed of a foam material and is attached to the grip part.

17. A musical instrument according to claim 11, wherein the grip part and a portion of the grip head consists of a harder material selected from the group consisting of plastic, wood, cork and metal, and the grip head has a groove into which there is inserted an insert which consists of foam material and which has a pocket to receive the sounding plate.

18. A musical instrument according to claim 17, wherein at least one of the grip head and the insert is detachably fastened to the grip part.

19. A musical instrument according to claim 18, wherein said grip part has a plurality of receivers for detachably fastening grip heads.

20. A musical instrument according to claim 1, wherein said separate holder element is detachable from the sounding plate.

21. A musical instrument according to claim 1, wherein said sounding plate is substantially flat.

* * * * *